US011549478B2

(12) United States Patent
Severson et al.

(10) Patent No.: US 11,549,478 B2
(45) Date of Patent: Jan. 10, 2023

(54) SELF-CONTAINED ENGINE BLOCK HEATER POWER SUPPLY

(71) Applicant: Start & Go LLC, Ault, CO (US)

(72) Inventors: Lloyd Duane Severson, Evans, CO (US); Mitchell Dallas Roberts, Ault, CO (US)

(73) Assignee: Start & Go LLC, Ault, CO (US)

( * ) Notice: Subject to any disclaimer, the term of this patent is extended or adjusted under 35 U.S.C. 154(b) by 0 days.

(21) Appl. No.: 17/514,185

(22) Filed: Oct. 29, 2021

(65) Prior Publication Data

US 2022/0136476 A1 May 5, 2022

Related U.S. Application Data

(60) Provisional application No. 63/107,038, filed on Oct. 29, 2020.

(51) Int. Cl.
*F02N 19/02* (2010.01)
*F02N 19/00* (2010.01)

(52) U.S. Cl.
CPC ..... *F02N 19/02* (2013.01); *F02N 19/001* (2013.01)

(58) Field of Classification Search
CPC ..... Y02T 10/70; Y02T 90/14; Y02T 90/10; B60L 2240/54; B60L 2240/545;
(Continued)

(56) References Cited

U.S. PATENT DOCUMENTS 5,469,819 A 11/1995 Berger et al.
7,258,092 B2 8/2007 Beaucaire et al.
(Continued)

FOREIGN PATENT DOCUMENTS

BR 102020016664 A2 * 6/2021
CN 103147898 A 6/2013
(Continued)

OTHER PUBLICATIONS

Hu, X., Zheng, Y., Howey, D. A., Perez, H., Foley, A., & Pecht, M., Battery warm-up methodologies at subzero temperatures for automotive applications: Recent advances and perspectives, Progress in Energy and Combustion Science, Mar. 2020, 77, 100806. See, e.g., highlighted sections.
(Continued)

*Primary Examiner* — George C Jin
*Assistant Examiner* — Teuta B Holbrook
(74) *Attorney, Agent, or Firm* — Greer, Burns & Crain, Ltd.

(57) ABSTRACT

One embodiment includes an engine block heating system. The engine block heating system includes a battery bank. The battery bank is configured to supply at least 2.25 KWatt-hours of energy before needing to be recharged. The battery bank is configured to be mounted in a vehicle comprising an engine block heater. The system further includes interface configured to connect to electrical connections of the engine block heater. The interface comprises an inverter is configured to supply at least 1500 Watts of power to the engine block heater. The engine block heating system is configured to selectively supply power from the battery bank to the engine block heater. The system further includes control circuitry coupled to the interface. The control circuitry stores a user-defined schedule to selectively control when the interface electrically connects the battery bank to the engine block heater.

20 Claims, 4 Drawing Sheets

(58) Field of Classification Search
CPC ..... B60L 2210/30; B60L 50/60; B60L 3/003; B60L 2240/445; B60L 2240/44; Y02E 60/10; B60H 1/004; B60H 2001/00128; B60H 2001/2234; B60H 2001/2228; H05B 1/0236; F02N 19/02
See application file for complete search history.

(56) References Cited

U.S. PATENT DOCUMENTS

| | | | | |
|---|---|---|---|---|
| 8,410,401 | B2 | 4/2013 | Thomas et al. | |
| 10,359,019 | B1 | 7/2019 | Springer | |
| 2008/0305922 | A1 | 12/2008 | Hoffmann | |
| 2010/0012068 | A1 | 1/2010 | Rodriguez et al. | |
| 2014/0150485 | A1* | 6/2014 | Weickert ..... | H01M 10/6568 62/259.2 |
| 2019/0248359 | A1* | 8/2019 | Miller ..... | B60W 50/0097 |
| 2020/0298705 | A1* | 9/2020 | Gaither ..... | B60R 16/033 |

FOREIGN PATENT DOCUMENTS

| | | | | | |
|---|---|---|---|---|---|
| CN | 111664037 | A | | 9/2020 | |
| DE | 102018004554 | A1 | * | 12/2019 | |
| EP | 1483639 | B1 | * | 11/2007 | ..... B60H 1/00314 |
| KR | 20210035879 | A | * | 4/2001 | |
| KR | 20210120668 | A | * | 10/2021 | |

OTHER PUBLICATIONS

Pereira, R., Plug-in Hybrid Vehicle (PHEV) Component Pre-Heater, Apr. 2013. See, e g., highlighted sections.

* cited by examiner

SELF-CONTAINED ENGINE BLOCK HEATER POWER SUPPLY

CLAIM OF PRIORITY AND CROSS-REFERENCE To RELATED APPLICATION

The present application claims the benefit of priority to U.S. Provisional Application Ser. No. 63/107,038 filed Oct. 29, 2020, incorporated herein by reference in its entirety.

FIELD OF THE DISCLOSURE

The present disclosure relates generally to powering engine block heaters and systems and methods related to the same.

BACKGROUND OF THE DISCLOSURE

Transportation vehicles and other heavy equipment vehicles are often used in a variety of different environmental conditions. For example, vehicles and heavy equipment are often used in the out-of-doors, and therefore subject to the extreme temperatures naturally occurring in various environments. For example, vehicles and heavy equipment are often required to operate in environmental temperatures as high as 110° F. down to −40° F. That is, even though these extreme conditions exist, shipping and other transportation must continue, and construction and other projects cannot be halted simply due to the extreme conditions.

Operation in these extreme conditions therefore presents various challenges. In cold environments, for example, starting the engines on vehicles and heavy equipment can be particularly difficult. This is even more true for vehicles and heavy equipment that employ diesel engines.

To overcome these challenges, engine block heaters have been used to maintain the engine block of the engines at a temperature where starting the engine is less difficult. Traditional engine block heaters are reliant upon electrical outlets connected to the power supply grid during cold temperatures in order to function. Many times, trucks and heavy equipment drivers do not have full access to power supply grid connected electrical outlets, rendering the engine block heaters unusable. In such circumstances, vehicle and heavy equipment operators can often nonetheless start the vehicles, but with additional difficulty which puts strain on the engine, the starter motor, the batteries powering the starter motor, and other portions of the vehicles and heavy equipment. Additionally, the vehicles and heavy equipment must be allowed to idle for a certain period of time before operating vehicles or heavy equipment. In industries with slim margins, costs computed per time of engine operation, with limited operator time, or due to fuel costs, this idling period can be expensive.

Large trucks such as semi-tractors or heavy equipment such as construction vehicles often are supplied with engine block heating devices that are installed by Original Equipment Manufacturers. These engine block heating devices have an AC cord and three prong plug intended to be used with AC power systems. That is, such OEM engine block heaters are configured to be plugged into a 3-prong electrical outlet electrically connected to the AC power/electrical supply grid.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

One embodiment illustrated herein includes an engine block heating system. The engine block heating system includes a battery bank. The battery bank is configured to supply at least 2.25 KWatt-hours of energy before needing to be recharged. The battery bank is configured to be mounted in a vehicle comprising an engine block heater. The system further includes interface configured to connect to electrical connections of the engine block heater. The interface comprises an inverter is configured to supply at least 1500 Watts of power to the engine block heater. The engine block heating system is configured to selectively supply power from the battery bank to the engine block heater. The system further includes control circuitry coupled to the interface. The control circuitry stores a user-defined schedule to selectively control when the interface electrically connects the battery bank to the engine block heater.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The above summary of the present disclosure is not intended to represent each embodiment, or every aspect, of the present disclosure. Additional features and benefits of the present disclosure will become apparent from the detailed description, figures, and claims set forth below Additional features and advantages will be set forth in the description which follows, and in part will be obvious from the description, or may be learned by the practice of the teachings herein. Features and advantages of the disclosure may be realized and obtained by means of the instruments and combinations particularly pointed out in the appended claims. Features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

Figure 1:
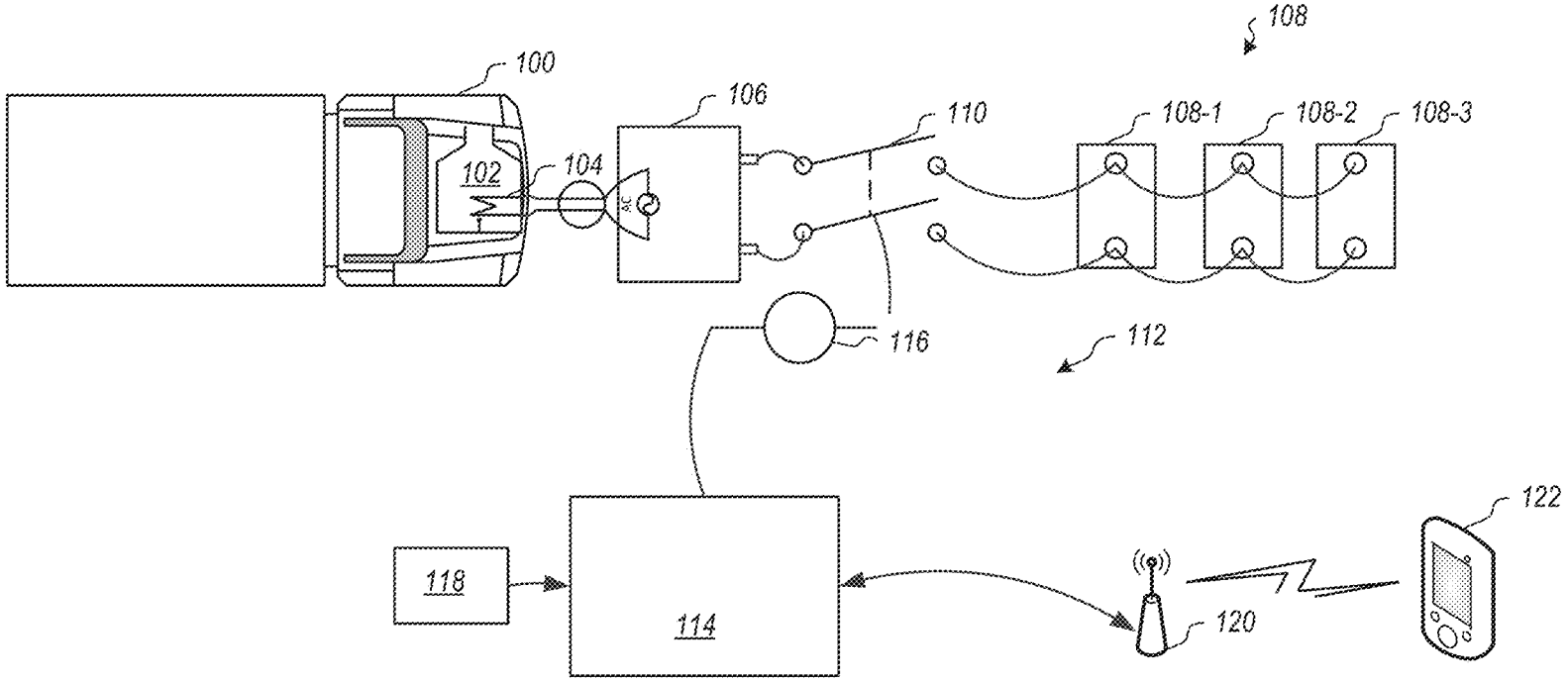
FIG. 1 illustrates a self-contained engine block heater system according to some embodiments.

While the disclosure is susceptible to various modifications and alternative forms, specific embodiments will be shown by way of example in the drawings and will be desired in detail herein. It should be understood, however, that the disclosure is not intended to be limited to the particular forms disclosed. Rather, the disclosure is to cover all modifications, equivalents and alternatives falling within the spirit and scope of the inventions as defined by the appended claims.

DETAILED DESCRIPTION OF THE ILLUSTRATED EMBODIMENTS

In the present disclosure, words of approximation such as "about", "substantially", or "generally" mean within ±10%.

Some embodiments of the disclosure illustrated herein implement a self-contained engine block heater system that does not require connection to grid connected power, but rather relies on portable and/or self-contained power sources implemented at a vehicle. For example, some embodiments include a battery bank coupled to a DC to AC inverter to produce an alternating current voltage at a sufficient voltage to power a standard engine block heater. Such an embodiment further includes a controller that is configured to automatically connect the battery bank to the DC to AC inverter at a predetermined time. For example, in a typical scenario, an engine block heater may need to be connected to a power source for about two hours prior to the engine being started to bring the engine block to a starting temperature. Thus, some embodiments may be configured to connect the inverter to the battery bank approximately two hours prior to when the vehicle is intended or expected to be operated.

Note that vehicle operators will often want to operate vehicles first thing in the morning. Thus, they will often want the engine block heater to be energized by a power source during times when the operator may be sleeping or otherwise pre-disposed. By including control circuitry to connect the battery bank to the DC to AC inverter or engine block heater, the operator is relieved of manually causing the battery bank to be connected to the DC to AC inverter or engine block heater, thus allowing the operator additional rest time or time for other activities.

In some embodiments, the control circuitry configured to connect the battery bank to the DC to AC inverter or engine block heater includes a clock or real-time clock to prevent time drifts which might cause the engine block heater to be energized at inappropriate times causing premature discharge of the battery bank or not energizing the battery engine block heater at a time that allows for sufficient time to heat the engine block to a starting temperature.

In some embodiments, the control circuitry is further connected to wireless circuitry or other communication hardware that allows the control circuitry to be connected to external computing systems, such as cellular telephones, tablets, or other devices to allow for programming of the control circuitry to schedule when the engine block heater is energized.

Specific details are now illustrated. Referring now to FIG. 1, an example is illustrated. FIG. 1 illustrates a vehicle 100, which in this example is a tractor-trailer semi-truck. Alternatively, the vehicle may be heavy equipment such as earthmovers such as backhoes, loaders, bulldozers, graders, excavators, dump trucks or other heavy equipment such as cranes, tractors, paving equipment, or any one of a multitude of different pieces of equipment. According to some embodiments, the vehicle is an Over The Road truck or piece of heavy equipment. According to some embodiments, the vehicle 100 comprises an engine having a volume of at least 6.0 L, at least 8.0 L, at least 10.0 L, at least 12.0 L, and/or at least 14.0 L. For example, in some embodiments, the vehicle 100 comprises a Caterpillar 3406E 14.6 liter diesel engine.

FIG. 1 illustrates that the vehicle 100 includes an engine block 102. The engine block 102 has an engine block heater 104 installed in the engine block 102. According to some embodiments, the engine block heater is connected to a power cord with a standard plug such as a 3-prong plug, intended to be inserted into a receptacle of a grid connected power supply such as an outlet connected to the electrical grid. According to some embodiments, the engine block heater 104 is OEM installed equipment. According to some embodiments, the engine block heater 104 is configured to heat an engine having a volume of at least 6.0 L, at least 8.0 L, at least 10.0 L, at least 12.0 L, and/or at least 14.0 L. One example of an engine block heaters 104 is a Hotstart® In-Block heaters, for example, Part #CATB-151 for a Caterpillar 1674 motor. Another example of an engine block heaters 104 is a Zerostart® engine heater, 1500 W 120V, part 350-0013. According to some embodiments, the engine block heater 104 requires 1500 watts. According to some embodiments, the engine block heater 104 heats coolant in the engine block 102 of the vehicle 100. According to some embodiments, the engine block heater comprises at least one heating element that is submerged in coolant which is contained in a water jacket of the engine block.

In the example illustrated in FIG. 1, the engine block heater 104 is coupled to a heater interface 106. According to some embodiments the interface 106 comprises a DC to AC inverter. According to some embodiments, including the illustrated embodiment, the heater interface 106 comprises an AC inverter, which receives as input on an input side of the inverter, DC power such as from a battery bank 108. In particular, a typical DC to AC inverter might receive 12 V DC input which is converted by various means to a 120 V RMS 60 Hz output at an output side of the DC to AC inverter. According to some embodiments, the heater interface comprises an electrical receptacle, such as a 3-pronged receptacle, into which the power cord (e.g., a power cord having a 3-prong plug) of the engine block heater 104 may be inserted.

While the interface 106 is illustrated in FIG. 1 as a DC to AC inverter, it should be appreciated that in other embodiments other devices can be used instead. For example, a typical engine block heater is simply a resistive heating device that is often not dependent on the power source being an AC power source. However, the typical engine block heater will nonetheless require a certain voltage, whether AC or DC, to be able to generate sufficient heat to warm the engine block 102 to a starting temperature. Thus, in some embodiments, a buck booster boost converter or other device may be used. In particular, a buck booster boost converter is a device that is configured to receive an input voltage (such as 12 VDC) at an input side of the buck booster boost converter and to increase the input voltage of a DC source to some higher DC voltage that is output at an output side of the buck booster. Thus, some embodiments may substitute the DC to AC inverter for a buck booster boost converter that converts 12 VDC at an input side to 120 VDC at an output side. According to some such embodiments, the power cord of the engine block heater 104 may need to be modified such as by removing a 3-prong plug and electrically coupling the engine block heater 104 to the interface 106 in another manner.

As noted above, according to some embodiments, the engine block heater 104 may require as much as or least 1500 W to operate properly. Thus, an interface 106 must be capable of delivering sufficient current to power the engine block heater 104. Thus, in one example, the interface 106 comprising an inverter sized and configured to deliver 1500 W or at least 1500 W of power to the engine block heater 104.

Similarly, a battery bank 108 must be sized sufficiently to source an appropriate amount of energy, which is an amount of power for a particular amount of time. Thus, for example, assuming that there are no losses at the interface 106 itself, and assuming a 2-hour time period during which the engine block heater 104 must be energized to bring the engine block 102 to a starting temperature, then 3 kWh of energy is needed from the battery bank 108. (i.e., 1500 watts*2 hours=3000 watt-hours=3 kWh). According to some embodiments, the battery bank 108 is configured to supply at least about 3 kWh of energy or at least about 3.5 kWh of energy, or at least about 4 kWh of energy.

In the example illustrated in FIG. 1, three batteries 108-1, 108-2, and 108-3 are illustrated. While three batteries are illustrated it should be appreciated that the number of batteries can be selected depending on the particular implementation and conditions. In particular, the number of batteries for the battery bank 108 can be selected based on the amp hour ratings of the batteries, requirements of the engine block heater 104, energy losses of the interface 106 and associated wiring, and other factors. Thus, according to some embodiments, each of the batteries in the battery bank 108 will need to be at least 83.3 amp-hour batteries (i.e., 83.3 amp hours×12 volts×3 batteries=about 3000 Wh). In some embodiments, based on experimental results, three batteries are used, and the batteries are selected to be in the range between 150 to 270 Amp-Hours.

According to some embodiments, four batteries are used. Thus, according to some embodiments, each of the batteries in the battery bank 108 will need to be at least 62.5 amp-hour batteries to achieve 3000 Wh (i.e., 62.5 amp hours×12 volts×4 batteries=3000 Wh). According to some embodiments, four batteries are used to increase the energy obtainable (e.g., 83.3 amp hours*12 V*4 batteries=about 4000 Wh). In some embodiments, based on experimental results, four batteries are used, and the batteries are selected to be in the range between 150 to 270 Amp-Hours. In some embodiments, based on experimental results, four batteries are used, and the batteries are selected to be in the range between 150 to 600 Amp-Hours.

Various battery technologies can be used to implement the batteries of the battery bank 108. For example, in some embodiments the batteries in the battery bank 108 are lead-acid batteries. In some embodiments, the batteries are deep-cycle batteries. According to some embodiments, the battery bank 108 comprises flooded lead-acid batteries which do not need to be heated before being used such as, for example, three (3) flooded lead-acid batteries or four (4) flooded lead-acid batteries. According to some embodiments, the battery bank 108 comprises a lead-acid, deep cycle battery pack that is configured to provide at least or at least about 2.25 kWh of power to the engine block heater 104, or at least or at least about 3 kWh of power to the engine block heater 104, or at least or at least about 4 kWh of power to the engine block heater 104. In some embodiments, the batteries may be implemented using hydrogen fuel cells. According to some embodiments, the battery bank 108 comprises lead-acid batteries which when fully charged will not freeze down to at least −40 F. Conversely, it is noted that it is dangerous to charge a Lithium battery when it is below 32 F. According to some embodiments, the battery bank 108 comprises lead-acid batteries which work up to 110 F before damage starts to occur to the batteries.

FIG. 1 illustrates that the batteries in the battery bank 108 are coupled together through wiring or busbars. The wiring or busbars must be sized sufficiently to carry sufficient amperage of current between the batteries and to the interface 106. For example, in the illustrated example, the wiring and busbars may need to be capable of carrying 125 A of DC current. This may require a minimum of 2 AWG copper wiring or similarly sized bus bars.

The batteries in the battery bank 108 may be configured to be charged through various means. For example, in some embodiments, the charging system of the vehicle 100 (such as an alternator or other charging system) is used to charge the batteries in the battery bank 108 when the vehicle 100 is operating under ordinary circumstances and the engine block heater system is configured to enable the charging system of the vehicle 100 to charge the batteries in the battery bank 108. Alternatively or additionally, other power sources such as solar power implemented on the vehicle 100, including on a trailer coupled to the vehicle 100, may be used to charge the batteries in the battery bank 108. According to some embodiments, the engine block heater system is configured to enable the vehicle charging system to charge the batteries in the battery bank 108 the entire time the vehicle 100 is running and/or until the batteries in the battery bank 108 are fully charged.

In some embodiments, the battery bank 108 is configured to be mounted in various available locations in or about the vehicle 100. For example, in some embodiments, the vehicle 100 will include stairs allowing the operator to move into the cab of the vehicle 100. The space underneath the stairs represents a location where the batteries can be mounted via brackets or other mounting hardware such that the batteries of the battery bank 108 can be inconspicuously placed in or about the vehicle 100. Accordingly, in some embodiments, the battery bank 108 and/or batteries are mounted to the stairs of the vehicle in the space underneath the stairs. In some embodiments, the battery bank 108 can be and is mounted in available space in an engine bay. In some embodiments, the battery bank 108 can be and is mounted behind seats or in other locations in the cab of a vehicle. Other locations may be used, alternatively or additionally.

FIG. 1 further illustrates a contactor 110 that is configured to connect the battery bank 108 to the interface 106. As with the other items illustrated herein, the contactor must be sized sufficiently to carry the amount of DC current to appropriately energize the engine block heater 104. For example, according to some embodiments, the contactor 110 is sized to handle at least 125 DC amps.

In the example illustrated in FIG. 1, control circuitry 112 is configured to control the contactor 110 for causing the battery bank 108 to be coupled to the interface 106. In particular, the control circuitry 112 comprises storage media such as a memory storing information to allow the control circuitry 112 to know when to activate the contactor 110 to cause power from the battery bank 108 to be supplied to the interface 106.

For example, the control circuitry 112 may include a microcontroller 114. The microcontroller 114 may include microprocessors, memory, and other components to perform computing functionality. The microcontroller 114 may store information, including scheduling information indicating when the contactor 110 should be actuated. That is, the microcontroller 114 can execute computer executable instructions to monitor a time such as a present time as well as a scheduled time for actuating the contactor 110. According to some embodiments, the microcontroller 114 comprises a clock and/or is communicatively coupled to an external clock to determine a time or the present time. According to some embodiments, when the determined time meets or exceeds the scheduled time, the microcontroller 114 will cause the contactor 110 to be actuated. Embodiments may include sufficient memory to hold the firmware that powers on the control circuitry and configures it for use, holds a scheduled time and/or a predetermined, user-defined schedule, and/or be able to communicate via Bluetooth. Note that in some embodiments, the schedule may be a daily, weekly, monthly, or other schedule as appropriate.

According to some embodiments, the memory of the microcontroller 114 is configured to store a user-defined schedule. According to some embodiments, the user-defined schedule comprises a scheduled start time for each of a plurality of days of the week and/or for each of a plurality of days of a month and/or year. For example, a user may set a first start time, e.g., 5:00 a.m., for a first set of one or more days of the week, e.g., Monday, Tuesday, Wednesday, and Thursday, and a second start time, e.g., 6:30 a.m. for a second set of one or more days of the week, e.g., Friday and Saturday, and set no start time for a third one or more days of the week, e.g., Sunday. The system contains a clock keeping track of the time and the day of the week and/or day of the month and/or year. In the above example, when the current time reaches 5:00 a.m. on Mondays, the microcontroller causes the battery bank to supply power to the interface and/or engine block heater. In the above example, when the current time reaches 6:30 a.m. on Fridays, the microcontroller causes the battery bank to supply power to the interface and/or engine block heater. On Sundays, the microcontroller does not cause the battery bank to supply power to the interface and/or engine block heater. Additionally, the memory may store one or more offset values which may be set to adjust a scheduled start time. For example, if the temperature on a Monday is determined by the microcontroller to be below a threshold temperature or within a threshold temperature range, the microcontroller may cause the battery bank to supply power to the interface and/or engine block heater when the current time reaches the scheduled time less an offset value, e.g., 30 minutes. For example, when the offset value is 30 minutes and the outside temperature is determined to be between 20° F. to −10° F., when the current time reaches 4:30 a.m. on the Monday, the microcontroller causes the battery bank to supply power to the interface and/or engine block heater, that is, a half hour earlier than the otherwise scheduled time. As another example, when the offset value is 30 minutes and the outside temperature is determined to be above 20° F., when the current time reaches 5:00 a.m. on the Monday, the microcontroller causes the battery bank to supply power to the interface and/or engine block heater, that is, at the otherwise scheduled time.

Note that often microcontrollers do not include sufficient power to be able to directly actuate a contactor capable of carrying the amounts of current required. For example, a typical contactor is an electromagnetic device that includes an electromagnetic coil configured to actuate a switch to physically move conductors in the contactor. Due to the large size of the conductors, the electromagnetic coil often requires more current than can be delivered by microcontroller circuitry. Thus, according to some embodiments, the engine block heater system comprises a relay. In the present example, a relay 116 is illustrated. Often such relays are solid-state relays. A solid-state relay functions by receiving signal level power from a device such as the microcontroller 114 which allows higher current levels to flow through the relay 116. In some embodiments, the higher current levels may be provided by the battery bank 108 through the relay 116 to the coil of the contactor 110.

Figure 4:
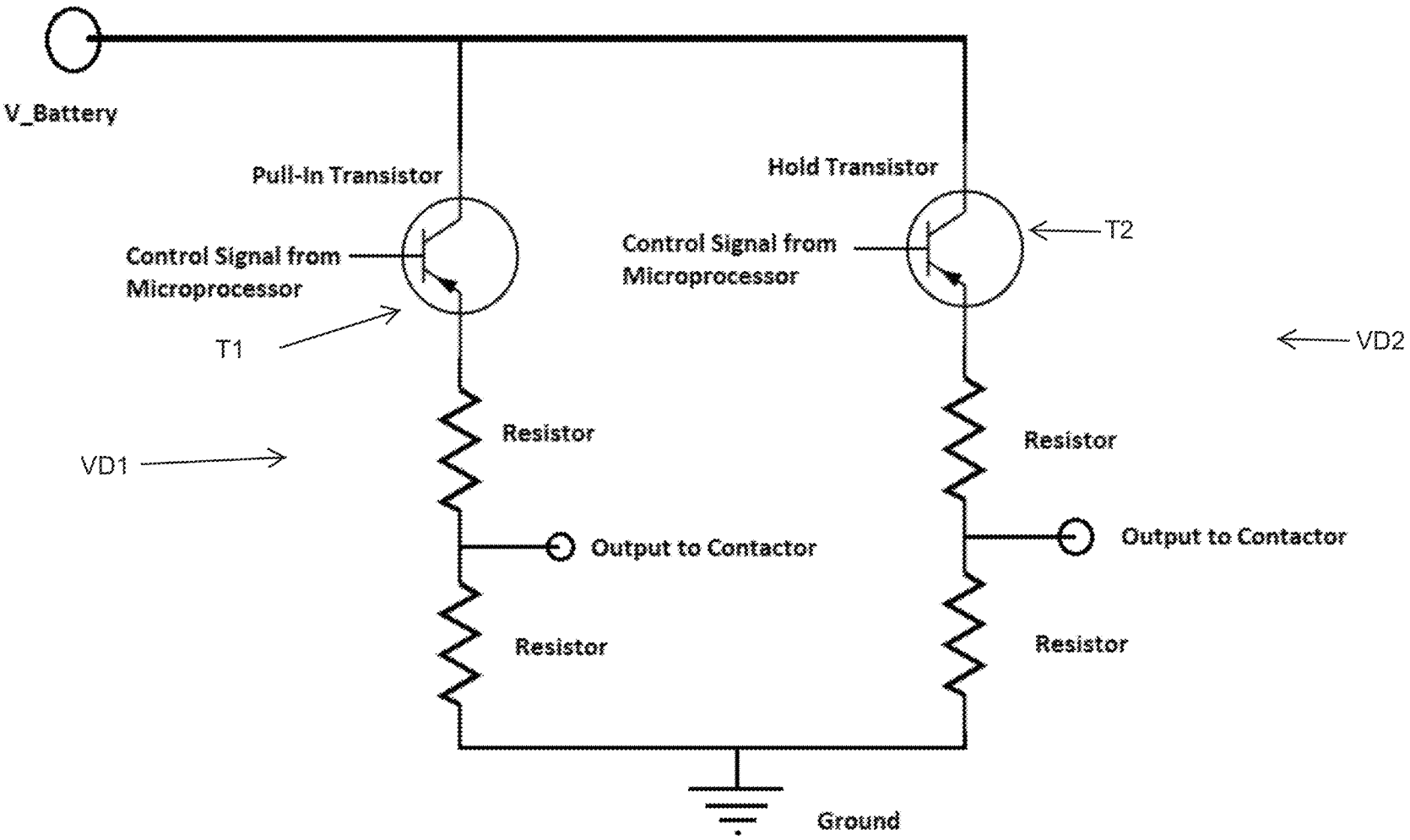
FIG. 4 illustrates additional control circuitry to control a contactor according to some embodiments.

Thus, according to some embodiments, additional control circuitry may be added to control the contactor 110. Referring to FIG. 4, according to some embodiments the additional circuitry consists of two voltage divider circuits VD1, VD2 that are controlled by two transistors, T1, T2. The micro-controller 114 activates a first one of the transistors T1 via the micro-controller's output port which supplies power to an input terminal on the first transistor T1 which connects a voltage supply V_Battery on the PCB to the voltage divider network. The first network comes on to provide the pull in voltage and stays on for 1 second, then shuts off. Simultaneously while the first circuit is turning off, the second circuit is activated to provide the holding voltage for the contactor 110. According to some embodiments, the pull in voltage is 7.5V, the holding voltage is 3.5V, and the coil resistance is 13.5 ohm.

In some embodiments, control signal output from the microcontroller 112 is approximately 3.3 v at 250 mA or less current. However, the input for controlling the contactor 110 may have a pull-in Voltage of 7.5 VDC and a holding voltage of 3.5 VDC, with a coil resistance of 13.5Ω. Thus, as illustrated, some embodiments may use a relay 116, such as a solid-state relay that is driven by the microcontroller 114 to output sufficient power for the coil of the contactor 110.

Returning once again to the control functionality of the microcontroller 114, as discussed previously, in some embodiments the microcontroller 114 will monitor a clock time as compared to a stored scheduled time to determine when to actuate the contactor 110. In some embodiments, the clock time may be provided by a clock 118 such as, for example, a real-time clock. According to some embodiments, the clock 118 is a real-time clock (i.e., a clock at least periodically coupled to an external time source such as, for example, the internet to maintain its indication of the present time in alignment with an external recognized source providing an accurate indication of the current time). According to some embodiments, use of a real-time clock insurers that the clock time used by the microcontroller 114 to determine the present time does not drift beyond acceptable limits from a recognized accurate source of the present time. In particular, as discussed above, if the present time used by the microcontroller 114 drifts too much in either direction, this could cause deleterious effects. For example, the drift in one direction might result in a case where the battery bank 108 does not have sufficient energy to energize the engine block heater 104 until it is time to start the engine block 102. For example, if the clock time identified by the microcontroller 114 is an hour ahead of the actual present time, it is likely that the battery bank 108 will have its energy exhausted too soon. In contrast, if the present time identified by the microcontroller 114 is an hour behind the actual present time, then it is likely that there will not be sufficient time to energize the engine block heater 104 for a sufficient amount of time to heat the engine block 102 to a target starting temperature. Therefore, according to some embodiments the clock 118 that is a real-time clock can be used to ensure that the present time identified by the microcontroller 114 is within a sufficient tolerance of an actual present time.

Note that in some embodiments, the microcontroller 114 and other control circuitry may be powered by the battery bank 108, by an electrical system of the vehicle 100, by an independent power source dedicated for the control circuitry 112, or by other appropriate power sources.

As discussed previously, the microcontroller 114 may include programming configured to implement a user-defined schedule whereby energizing the engine block heater 104 is performed according to the schedule. In some embodiments, this schedule may be user-controlled by the user interacting with the microcontroller 114. In certain embodiments, this is accomplished by wireless or other communication using an external computing device communicatively coupled to the microcontroller 114. For example, FIG. 1 illustrates that the control circuitry 112 may include a wireless device 120. For example, the wireless device 120 may include a Bluetooth module, Wi-Fi module, near field communication module, or other appropriate device that is coupled to communication circuitry on the microcontroller 114. The wireless device 120 may be configured to communicate with a user device 122.

For example, the user device 122 may be a cellular smart phone, tablet, laptop computer, or other appropriate device. The user device 122 may include an app that includes functionality for working in conjunction with the microcontroller 114 to set the schedule controlled by the microcontroller 114.

In particular, some embodiments are configured to allow the user via a phone-based (or other device based) application over a Bluetooth (or other wireless) connection to set or adjust a start time setting and/or a run time setting stored in the microcontroller 114 which are used by the microcontroller to determine when and/or for how long to couple the battery bank 108 to the engine block heater 104. Some embodiments are designed to raise the temperature of the engine approximately 50 degrees while outside temperatures are above zero degrees Fahrenheit. According to some embodiments, if the outside temperature gets below zero, say −25 F, then the engine block heating system will not heat the engine the full 50 degrees but will still raise the temperature of the engine enough to allow a successful cold weather start. According to some embodiments, the outside temperature impacts how quickly or successfully the engine block heating system warms an engine. The colder it is outside the more the outside temperature will work to cool the engine while the engine block heating system works to heat up the engine. The warmer the outside temperature, the easier for the engine block heating system to warm the engine/engine block and the colder the outside temperature the harder for engine block heating system to warm the engine/engine block.

Some embodiments may include temperature sensors in the control circuitry 112 to adjust when the engine block heater 104 is energized. For example, when ambient temperatures are cooler, according to some embodiments, the microcontroller 112 receives one or more temperature readings from one or more temperature sensors, determines that/those temperature are below a threshold temperature, and adjusts a start time and/or run time setting(s) or value(s) stored in a memory of the microcontroller 112, for example, adjusting the start time value to cause the battery bank 108 to be couple to the engine block heater 104 at a sooner time compared to an otherwise stored start time or scheduled start time to ensure sufficient time to warm the engine block 102 to an appropriate target starting temperature. Conversely, if ambient temperatures are sensed to be comparatively warm, then the time when the engine block heater 104 is energized may be at a later time requiring less heating time of the engine block 102 by the engine block heater 104, for example, by the microcontroller 112 receiving one or more temperature readings from one or more temperature sensors, determining that/those temperature are above a threshold temperature and adjusting and start time and/or run time setting(s) or value(s) stored in a memory of the microcontroller 112, for example, adjusting the start time value to cause the battery bank 108 to be couple to the engine block heater 104 at a later time compared to an otherwise stored start time or scheduled start time.

Alternatively, or additionally in some embodiments, the control circuitry 112 may be able to receive weather information relevant to time and location of the control circuitry from the user device 122 when the control circuitry 112 is coupled to the user device 122. This weather information may be stored in a memory of the microcontroller 114, and so long as it is current and relevant, then this weather information can be used to adjust when the engine block heater 104 is energized according to the user defined schedule. In some embodiments, the control circuitry 112 may include location hardware, such as GPS sensors or other hardware, in the event that current location of the control circuitry 112 (and thus the vehicle 100) needs to be determined for applying appropriate weather information when controlling when to energize the engine block heater 104. For example, in some embodiments, a vehicle itinerary can exist on the user device 122. Weather information for vehicle itinerary can be downloaded to the control circuitry 112, and in particular the microcontroller 114. The control circuitry 112 can then determine an exact location for the vehicle 100 in context with the user defined schedule. Using the present location of the vehicle 100, the control circuitry 112 can control energizing the engine block heater 104 based on the known location and the weather information to compensate for the anticipated temperature of the ambient environment for the vehicle 100. Note that in some embodiments, the location hardware may be part of the vehicle 100 itself and may be configured to communicate with the control circuitry 112 such as via using the wireless device 120.

Having the capability to warm up the engine prior to start up can reduce the engine idle time significantly. Reducing the idle time will save wear and tear to the engine increasing engine life and reducing maintenance and labor costs. Reducing engine idle time also reduces fuel consumption which provides an immediate return on investment for the consumer and also significantly reduces $CO_2$ gas emissions.

As noted previously, in some embodiments the primary power source for the control circuitry 112 is the battery bank 108. Alternatively or additionally, power can be provided from a vehicle battery installed in the vehicle 100 for other purposes. According to some embodiments, if power from these batteries is lost then another battery that comprises part of the control circuitry 112 such as, for example, a coin-cell battery such as, for example, a Li—Po or other dry metal battery, can provide power and allow the microcontroller 114 and/or other circuitry in the control circuitry 112 to go into a sleep mode. For example, some embodiments may implement the following process:

- Vehicle battery power is lost
  - Microcontroller 112 instantly/immediately switches to a coin-cell battery
  - Microcontroller 112 powers down and goes to sleep
  - Microcontroller 112 waits until truck battery power is re-established, as sensed through a digital input of the microcontroller 112
  - Once power is reestablished then the Microcontroller 112 wakes up and resumes normal function In some embodiments, a coin-cell battery is recharged from vehicle batteries or other vehicle charging system.

Note that in some embodiments the coin-cell battery is not intended to support Bluetooth communication. Thus, some embodiments are configured to communicate with the user device 122 only when sufficient power is provided to the control circuitry 112, such as through the battery bank 108.

Some embodiments may include various indicator lights in the control circuitry 112 that allows a user to visually perceive the status of the control circuitry 112. For example, some embodiments may include one or more RGB LEDs (or other indicators) that indicates if the control circuitry 112 is "Listening" or "Paired". For example, in some embodiments a default mode is "Listening" when initially powered on or not paired with a phone. In some embodiments, the indicator lights are able to indicate error states.

Some embodiments may include a reset button that will reset the control circuitry 112. In some embodiments, actuation of the reset button will cause the contactor 110 to open and remain open until normal operating conditions and operating schedule is verified.

In some embodiments, the microcontroller 114 includes an external antenna connector for connecting to at least a portion of the wireless device 120.

Note that in some embodiments, all or portions of the control circuitry 112 may be integrated with the microcontroller 114 and/or interface 106. For example, the control circuitry 112 and microcontroller 114 may be housed in a common electrical housing as the interface 106. In some embodiments, the control circuitry 112 may share circuit boards and circuit wiring with the microcontroller 114 and/or interface 106. Indeed, in some embodiments, all or portions of the control circuitry 112 may use processors, memory, or other components to perform the functionality of the control circuitry 112 where those processors, memory, or other components are also used to perform the functionality of the microcontroller 114 and/or interface 106.

Embodiments are configured to be mounted to the vehicle 100, including in and about the vehicle 100. For example, as noted above, the battery bank 108 may be mounted under stairs of the vehicle 100. The interface 106 may be mounted in the cab of the vehicle and/or in available space in the engine compartment of the vehicle 100. The control circuitry 112, including the microcontroller 114, clock 118, and wireless device 120 may be mounted in the cab of the vehicle and/or in available space in the engine compartment of the vehicle.

Figure 2:
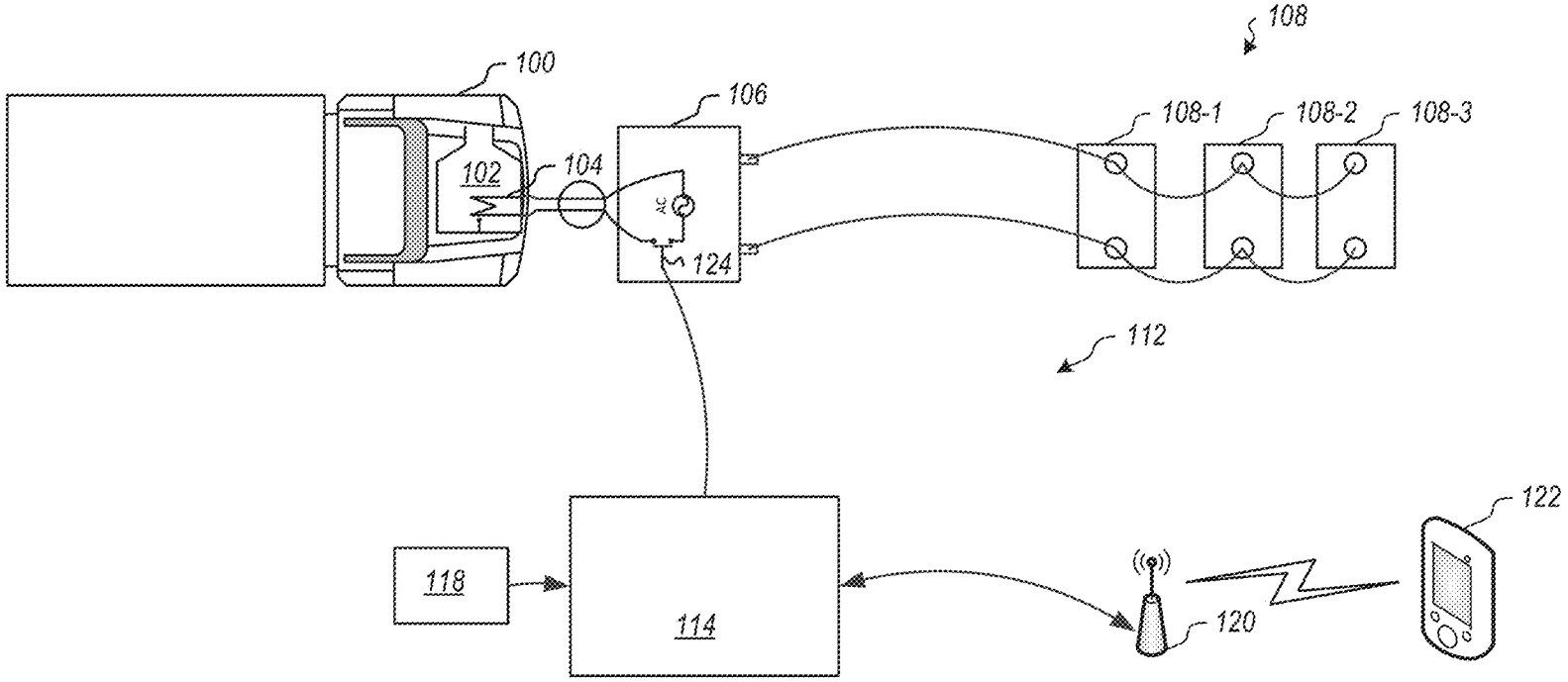
FIG. 2 illustrates a self-contained engine block heater system according to some embodiments.

While the example illustrated above in FIG. 1 is illustrated where a contactor 110 is used to connect the battery bank 108 to the interface 106, it should be appreciated that in other embodiments, selectively controlling supplying power from the battery bank 108 to the engine block heater 104 can be accomplished by a switch on an output side of the interface 106. For example, as illustrated in FIG. 2, a switch 124 that is controllable by the microcontroller 114 is able to close an output circuit of the interface 106 to allow the interface to energize the engine block heater 104. In this example, the battery bank 108 is coupled fixedly or semi-fixedly to the interface 106 and selective functionality is provided at the output side of the interface 106. In this embodiment, a small amount of current will be drawn from the battery bank 108 to power the interface 106 even during periods when the interface 106 is not energizing the engine block heater 104. As such, design considerations need to be adhered to, to ensure that the battery bank 108 includes sufficient energy to account for these small current draws.

The following discussion now refers to a number of methods and method acts that may be performed. Although the method acts may be discussed in a certain order or illustrated in a flow chart as occurring in a particular order, no particular ordering is required unless specifically stated, or required because an act is dependent on another act being completed prior to the act being performed.

Figure 3:
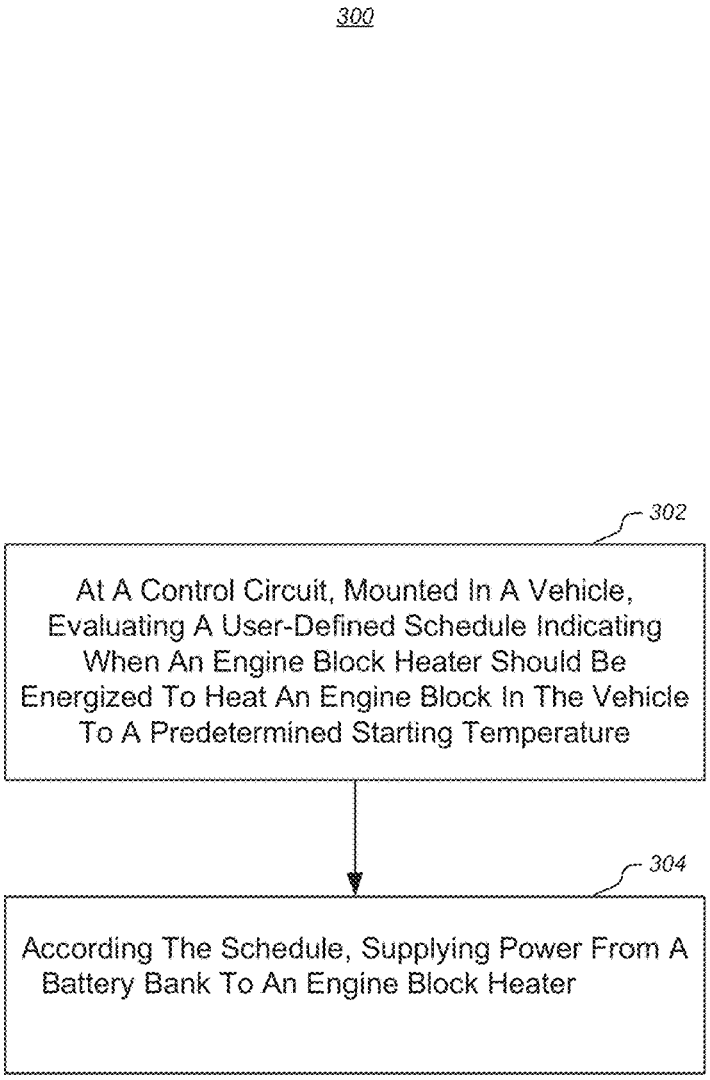
FIG. 3 illustrates a method of using a self-contained engine block heater system according to some embodiments; and according to some embodiments.

Referring now to FIG. 3, a method 300 is illustrated. The method 300 illustrates acts for heating an engine block of a vehicle. The method 300 includes, at a control circuit, mounted in a vehicle, evaluating a user-defined schedule indicating when an engine block heater should be energized to heat an engine block in the vehicle to a predetermined starting temperature (act 302).

The method 300 further includes, according to the schedule, supplying power from a battery bank to an engine block heater (act 304). According to some embodiments, the battery bank is configured to supply at least 1 KWatt-hours or at least about 1 KWatt-hours of energy before needing to be recharged. According to some embodiments, the battery bank is configured to supply at least 2 KWatt hours or at least about 2 KWatt hours of energy before needing to be recharged. According to some embodiments, the battery bank is configured to supply at least 2.25 KWatt hours or at least about 2.25 KWatt hours of energy before needing to be recharged. According to some embodiments, the battery bank is configured to supply at least 3 KWatt hours or at least about 3 KWatt hours of energy before needing to be recharged. According to some embodiments, the battery bank is configured to supply at least 4 KWatt hours or at least about 4 KWatt hours of energy before needing to be recharged. Further, according to some embodiments, the battery bank is configured to be mounted to a vehicle having the engine block heater, and wherein the engine block heater interface is configured to supply at least 500 Watts or at least about 500 Watts of power to the engine block heater. Further, according to some embodiments, the battery bank is configured to be mounted to a vehicle having the engine block heater, and wherein the engine block heater interface is configured to supply at least 1000 Watts or at least about 1000 Watts of power to the engine block heater. Further, according to some embodiments, the battery bank is configured to be mounted to a vehicle having the engine block heater, and the battery bank, the engine block heater interface, and the inverter are configured to supply at least 1500 Watts or at least about 1500 Watts of power to the engine block heater for at least two hours before the batteries in the battery bank need to be recharged. According to some embodiments, the battery bank, the engine block heater interface, and the inverter are configured to supply at least 2500 Watts or at least about 2500 Watts of power to the engine block heater for at least two hours before the batteries in the battery bank need to be recharged. According to some embodiments, the battery bank, the engine block heater interface, and the inverter are configured to supply at least 3000 Watts or at least about 3000 Watts of power to the engine block heater for at least two hours before the batteries in the battery bank need to be recharged. According to some embodiments, the battery bank, the engine block heater interface, and the inverter are configured to supply at least 3500 Watts or at least about 3500 Watts of power to the engine block heater for at least two hours before the batteries in the battery bank need to be recharged. According to some embodiments, the battery bank, the engine block heater interface, and the inverter are configured to supply at least 4000 Watts or at least about 4000 Watts of power to the engine block heater for at least two hours before the batteries in the battery bank need to be recharged. According to some embodiments, the battery bank, the engine block heater interface, and the inverter are configured to supply at least 4500 Watts or at least about 4500 Watts of power to the engine block heater for at least two hours before the batteries in the battery bank need to be recharged.

The method 300 may be practiced where supplying power from a battery bank to an interface is performed by activating a contactor configured to selectively couple the battery bank to the interface to allow the battery bank to supply power to the engine block heater. According to some embodiments, the contactor is configured to safely carry at least 45 Amps of DC current.

The method 300 may be practiced where supplying power from a battery bank to an interface is performed by the control circuitry being coupled to an input side of the interface, and selectively coupling the input side of the interface to the engine block heater.

The method 300 may further include the control circuitry connecting to an external user device and receiving schedule information defining the user-defined schedule from the external user device.

The method 300 may be practiced where supplying power from a battery bank to an engine block heater includes supplying power to an interface.

The method 300 may be practiced where supplying power from a battery bank to an interface includes supplying power to a buck booster.

The method 300 may further include referencing a real-time clock to ensure that a present time used by the control circuitry when evaluating the user defined schedule is within a predetermined threshold of an actual present time. Some such embodiments may further include updating the real-time clock to Internet time available to an external user device with an Internet connection whenever the control circuitry is connected to the external user device.

The method 300 may further include mounting the battery bank to stairs of the vehicle.

The method 300 may further include recharging the battery bank using a charging system of the vehicle. According to some embodiments, the vehicle charging system charges the batteries in the battery bank 108 the entire time the vehicle 100 is running.

Further, at least portions of the methods may be practiced by a computer system including one or more processors and computer-readable media such as computer memory. In particular, the computer memory may store computer executable instructions that when executed by one or more processors cause various functions to be performed, such as the acts recited in the embodiments.

Embodiments of the present disclosure may comprise or utilize a special purpose or general-purpose computer including computer hardware, as discussed in greater detail below. For example, the microcontroller 114 or other circuitry illustrated can be implemented using the described special purpose or general-purpose computer. Embodiments within the scope of the present disclosure also include physical and other computer-readable media for carrying or storing computer-executable instructions and/or data structures. Such computer-readable media can be any available media that can be accessed by a general purpose or special purpose computer system. Computer readable media that store computer-executable instructions are physical storage media. Computer-readable media that carry computer-executable instructions are transmission media. Thus, by way of example, and not limitation, embodiments of the disclosure can comprise at least two distinctly different kinds of computer-readable media: physical computer-readable storage media and transmission computer-readable media.

Physical computer-readable storage media includes RAM, ROM, EEPROM, CD-ROM or other optical disk storage (such as CDs, DVDs, etc.), magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmission media can include a network and/or data links which can be used to carry desired program code means in the form of computer executable instructions or data structures and which can be accessed by a general purpose or special purpose computer. Combinations of the above are also included within the scope of computer-readable media.

Further, upon reaching various computer system components, program code means in the form of computer-executable instructions or data structures can be transferred automatically from transmission computer-readable media to physical computer-readable storage media (or vice versa). For example, computer-executable instructions or data structures received over a network or data link can be buffered in RAM within a network interface module (e.g., a "NIC"), and then eventually transferred to computer system RAM and/or to less volatile computer-readable physical storage media at a computer system. Thus, computer-readable physical storage media can be included in computer system components that also (or even primarily) utilize transmission media.

Computer-executable instructions comprise, for example, instructions and data which cause a general purpose computer, special purpose computer, or special purpose processing device to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the disclosure may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The disclosure may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Some embodiments of the present disclosure include the following:

Embodiment 1. An engine block heating system comprising:

a battery bank, wherein the battery bank is configured to supply at least 2.25 KWatt-hours of energy before needing to be recharged, and wherein the battery bank is configured to be mounted to a vehicle comprising an engine block heater;

an interface configured to connect to electrical connections of the engine block heater, wherein the interface comprises a DC to AC inverter configured to supply at least 1500 Watts of power to the engine block heater, wherein the system is configured to selectively supply power from the battery bank to the engine block heater; and;

control circuitry coupled to interface, wherein the control circuitry stores a user-defined schedule to selectively control when the interface electrically connects the battery bank to the engine block heater.

Embodiment 2. An engine block heating system comprising:

a vehicle mountable battery bank, wherein the battery bank is configured to supply at least about 2.25 KWatt-hours of energy before needing to be recharged;

an interface configured to connect to electrical connections of an engine block heater, wherein the interface comprises a DC to AC inverter configured to supply at least about 1500 Watts of power to the engine block heater; and;

control circuitry configured to selectively supply power from the battery bank to the engine block heater.

Embodiment 3. An engine block heating system comprising:

a vehicle mountable battery bank;

an interface configured to enable an engine block heater to be electrically coupled thereto; and control circuitry configured to selectively supply power from the battery bank to the engine block heater electrically coupled to the interface.

wherein the battery bank is configured to supply about 1500 watts of power to the engine block heater coupled to the interface for at least two hours.

Embodiment 4. A system comprising:

a vehicle comprising an engine having a volume of at least 6.0 L;

an engine block heater for warming the engine; and an engine block heating system comprising:

a battery bank;

an interface electrically coupled to the engine block heater; and control circuitry configured to selectively supply power from the battery bank to the engine block heater electrically coupled to the interface;

wherein the battery bank is configured to supply about 1500 watts of power to the engine block heater coupled to the interface for at least two hours.

Embodiment 5. The system according to any of Embodiments 1-4, further comprising a contactor configured to selectively couple the battery bank to the interface to allow the battery bank to supply power to the engine block heater, wherein the contactor is configured to safely carry at least 45 Amps of DC current.

Embodiment 6. The system according to any of Embodiments 1-4 wherein the control circuitry is coupled to a contactor, to selectively couple an output side of the interface to the engine block heater.

Embodiment 7 The system according to any of Embodiments 1-6, wherein the control circuitry further comprises wireless circuitry configured to connect to an external user device to allow the external user device to be used to define the schedule.

Embodiment 8. The system according to any of Embodiments 1-7, wherein the interface comprises a buck booster.

Embodiment 9. The system according to any of Embodiments 1-8, the control circuitry further comprising a real-time clock configured to ensure that a present time used by the control circuitry when evaluating the user defined schedule is within a predetermined threshold of an actual present time.

Embodiment 10. The system of Embodiment 9, wherein the real-time clock is configured to update its time to time obtained from the Internet available to an external user device with an Internet connection when the control circuitry is connected to the external user device.

Embodiment 11. The system according to Embodiment 4, wherein the battery bank is configured to be mounted to stairs of the vehicle.

Embodiment 12. The system according to any of Embodiments 1-11 configured deliver about 1500 watts of power to an engine block heater coupled to the interface for at least two hours.

Embodiment 13. The system according to any of Embodiments 1-12 wherein the battery bank comprises lead-acid batteries.

Embodiment 14. The system of Embodiment 13 wherein the battery bank comprises flooded lead-acid batteries.

Embodiment 15. The system according to any of Embodiments 1-14 wherein the battery bank is configured to supply at least about 3 KWatt-hours of energy before needing to be recharged.

Embodiment 16. The system according to any of Embodiments 1-14 wherein the battery bank is configured to supply at least about 4 KWatt-hours of energy before needing to be recharged.

Embodiment 17. The system according to any of Embodiments 1-16 wherein the interface comprises a 3-pronged receptacle into which a power cord having a 3-prong plug of the engine block heater may be inserted.

Embodiment 18. A method of heating an engine block the method comprising:

at a control circuit, mounted in a vehicle, evaluating a user-defined schedule indicating when an engine block heater should be energized to heat an engine block in the vehicle to a predetermined starting temperature;

according the schedule, supplying power from a battery bank to an interface, wherein the battery bank is configured to supply at least 2.25 KWatt-hours of energy before needing to be recharged, wherein the battery bank is configured to be mounted to the vehicle including the engine block heater, and wherein the interface is configured to supply at least 1500 Watts of power to the engine block heater.

Embodiment 19. The method of Embodiment 18, wherein supplying power from the battery bank to the interface is performed by activating a contactor configured to selectively couple the battery bank to the interface to allow the battery bank to supply power to the engine block heater, wherein the contactor is configured to safely carry at least 45 Amps of DC current.

Embodiment 20. The method according to any of Embodiments 18-19, wherein supplying power from the battery bank to the interface is performed by the control circuitry being coupled to an input side of the interface, and selectively coupling an output side of the interface to the engine block heater.

Embodiment 21. The method according to any of Embodiments 18-20, further comprising the control circuitry connecting to an external user device and receiving schedule information defining the user defined schedule from the external user device.

Embodiment 22. The method according to any of Embodiments 18-21, wherein supplying power from the battery bank to the interface comprises supplying power to a DC to AC inverter.

Embodiment 23. The method according to any of Embodiments 18-22, wherein supplying power from a battery bank to the interface comprises supplying power to a buck booster.

Embodiment 24. The method according to any of Embodiments 18-23, further comprising referencing a real-time clock to ensure that a clock time used by the control circuitry when evaluating the user-defined schedule is within a predetermined threshold of an actual present time.

Embodiment 25. The method of Embodiment 24, further comprising updating the real-time clock to time available from the Internet received from an external user device with an Internet connection when the control circuitry is connected to the external user device.

Embodiment 26. The method according to any of Embodiments 18-25, further comprising mounting the battery bank to stairs of the vehicle.

Embodiment 27. The method of according to any of Embodiments 18-26, further comprising recharging the battery bank using a charging system of the vehicle.

The present disclosure may be embodied in other specific forms without departing from its spirit or characteristics. The described embodiments are to be considered in all respects only as illustrative and not restrictive. The scope of the inventions are, therefore, indicated by the appended claims rather than by the foregoing description. All changes which come within the meaning and range of equivalency of the claims are to be embraced within their scope.

While the disclosure is susceptible to various modifications and alternative forms, specific embodiments have been shown by way of example in the drawings and described in detail herein. It should be understood, however, that the disclosure is not intended to be limited to the particular forms disclosed. Rather, the disclosure is to cover all modifications, equivalents and alternatives falling within the spirit and scope of the inventions as defined by the appended claims.

What is claimed is:

1. An engine block heating system comprising:

a battery bank, wherein the battery bank is configured to supply at least 2.25 KWatt-hours of energy before needing to be recharged, and wherein the battery bank is configured to be mounted to a vehicle comprising an engine block heater;

an interface configured to connect to electrical connections of the engine block heater, wherein the interface comprises a DC to AC inverter configured to supply at least 1500 Watts of power to the engine block heater, wherein the system is configured to selectively supply power from the battery bank to the engine block heater; and;

a control circuitry coupled to the interface wherein the control circuitry stores a user-defined schedule to selectively control when the interface electrically connects the battery bank to the engine block heater.

2. The system of claim 1, further comprising a contactor configured to selectively couple the battery bank to the interface to allow the battery bank to supply power to the engine block heater, wherein the contactor is configured to safely carry at least 45 Amps of DC current.

3. The system of claim 1, wherein the control circuitry is coupled to a contactor, to selectively couple an output side of the interface to the engine block heater.

4. The system of claim 1, wherein the control circuitry further comprises wireless circuitry configured to connect to an external user device to allow the external user device to be used to define the schedule.

5. The system of claim 1, wherein the battery bank is configured to be mounted to stairs of the vehicle.

6. The system of claim 1, wherein the battery bank is configured to be recharged using a charging system of the vehicle.

7. An engine block heating system comprising:

a vehicle mountable battery bank, wherein the battery bank is configured to supply at least about 2.25 KWatt-hours of energy before needing to be recharged;

an interface configured to connect to electrical connections of an engine block heater, wherein the interface comprises a DC to AC inverter configured to supply at least about 1500 Watts of power to the engine block heater; and;

a control configured to selectively supply power from the battery bank to the engine block heater.

8. The engine block heating system of claim 7 configured deliver about 1500 watts of power to an engine block heater coupled to the interface for at least two hours.

9. The engine block heating system of claim 7 wherein the battery bank comprises lead-acid batteries.

10. The engine block heating system of claim 9 wherein the battery bank comprises flooded lead-acid batteries.

11. The engine block heating system of claim 7 wherein the battery bank is configured to supply at least about 3 KWatt-hours of energy before needing to be recharged.

12. The engine block heating system of claim 7 wherein the battery bank is configured to supply at least about 4 KWatt-hours of energy before needing to be recharged.

13. The engine block heating system of claim 7 wherein the interface comprises a 3-pronged receptacle into which a power cord having a 3-prong plug of the engine block heater may be inserted.

14. An engine block heating system comprising:

a vehicle mountable battery bank;

an interface configured to enable an engine block heater to be electrically coupled thereto; and a control configured to selectively supply power from the battery bank to the engine block heater electrically coupled to the interface, wherein the battery bank is configured to supply about 1500 watts of power to the engine block heater coupled to the interface for at least two hours.

15. A system comprising:

a vehicle comprising an engine having a volume of at least 6.0 L;

an engine block heater for warming the engine; and an engine block heating system comprising:

a battery bank;

an interface electrically coupled to the engine block heater; and a control configured to selectively supply power from the battery bank to the engine block heater electrically coupled to the interface;

wherein the battery bank is configured to supply about 1500 watts of power to the engine block heater coupled to the interface for at least two hours.

16. A method of heating an engine block the method comprising:

at a control circuit, mounted in a vehicle, evaluating a user-defined schedule indicating when an engine block heater should be energized to heat an engine block in the vehicle to a predetermined starting temperature;

according the schedule, supplying power from a battery bank to an interface, wherein the battery bank is configured to supply at least 2.25 KWatt-hours of energy before needing to be recharged, wherein the battery bank is configured to be mounted to the vehicle including the engine block heater, and wherein the interface is configured to supply at least 1500 Watts of power to the engine block heater.

17. The method of claim 16, wherein supplying power from the battery bank to the interface is performed by activating a contactor configured to selectively couple the battery bank to the interface to allow the battery bank to supply power to the engine block heater, wherein the contactor is configured to safely carry at least 45 Amps of DC current.

18. The method of claim 16, wherein supplying power from the battery bank to the interface is performed by the control circuitry being coupled to an input side of the interface, and selectively coupling an output side of the interface to the engine block heater.

19. The method of claim 16, wherein supplying power from the battery bank to the interface comprises supplying power to a DC to AC inverter.

20. The method of claim 16, further comprising recharging the battery bank using a charging system of the vehicle.

* * * * *